United States Patent [19]

Rösch

[11] Patent Number: 4,953,717

[45] Date of Patent: Sep. 4, 1990

[54] HINGED MULTIPLE GARMENT HANGER

[76] Inventor: Wilhelm Rösch, Hinzbecker Höhe 30, Essen 15, Fed. Rep. of Germany

[21] Appl. No.: 389,124

[22] Filed: Aug. 3, 1989

Related U.S. Application Data

[63] Continuation-in-part of Ser. No. 360,886, May 24, 1989.

[51] Int. Cl.[5] ..... A47F 5/00

[52] U.S. Cl. ..... 211/113; 211/116

[58] Field of Search ..... 211/113, 116, 118, 123; 223/88, 89; 248/290, 294, 304, 340, 341

[56] References Cited

U.S. PATENT DOCUMENTS

| | | | |
|---|---|---|---|
| 2,699,263 | 1/1955 | Ore | 211/116 X |
| 2,709,005 | 5/1955 | Eckstein | 211/113 |
| 2,714,965 | 8/1955 | Fitzkee et al. | 211/113 |
| 4,129,218 | 12/1978 | Koellner | 211/116 |
| 4,308,962 | 1/1982 | Fahmi | 248/340 X |
| 4,709,838 | 12/1987 | Campbell | 248/340 X |

*Primary Examiner*—Robert W. Gibson, Jr.
*Attorney, Agent, or Firm*—Nils H. Ljungman

[57] ABSTRACT

An improved multiple garment hanging device is for simultaneously hanging and storing several articles of clothing or the like on a clothes hanger rod, which includes a rigid bar having a plurality of holes extending therethrough for receipt of clothes hanging elements therein, a pair of hooks pivotably mounted at opposite end of the rigid bar, the pair of hooks being substantially alignable toward each other for being held by a human hand for supporting the garment hanging device at least during insertion of the clothes hanging elements in the holes of the rigid bar. The rigid bar has a central plane and a longitudinal axis lying within the central plane, and the plurality of holes are separated one from the other and displaced along the longitudinal axis, with each of the holes extending substantially perpendicular to the central plane. The rigid bar has a pivot hole at each of the opposite ends thereof which extends substantially perpendicular to the central plane. Each of the pair of hooks lies substantially along a circle, with the circle having a center, and each of the pairs of hooks extends along a substantial portion of the circle to have a free end and a pivot end having a pivot axis which is disposed within the pivot hole of the rigid bar with the center of the circle of the hook being located within the central plane of the rigid bar during relative rotation of the pivot axis within the pivot hole. The central plane extends vertically below the clothes hanger rod when both of the hooks are engaged with the clothes hanger rod as well as when only one of the hooks is engaged with the clothes hanger rod.

7 Claims, 8 Drawing Sheets

HINGED MULTIPLE GARMENT HANGER

CROSS-REFERENCE TO RELATED APPLICATIONS

The present application is a continuation-in-part of International Application/PCT Serial No. PCT/DE88/00420, filed on Jul. 7, 1988, assigned U.S. Ser. No. 360,886, entered May 24, 1989.

BACKGROUND OF THE INVENTION

1. Field of the Invention

The invention relates to a garment hanger for the simultaneous hanging and storing of several articles of clothing, with a carrying element provided with suspension hooks for hanging on a clothes hanger bar or the like. The carrying element may include several carrying bars pivotable with respect to the carrying element, with the carrying bars being dimensioned to accommodate the garment to be held. The carrying element may include holes for the receipt of clothes hangers for accommodating a wide variety of garments thereon.

2. Description of the Prior Art

Such hangers are known which can simultaneously hold several garments, for instance trousers, whereby several carrying bars running mutually parallel in the same plane are assigned to a carrying element provided with a suspension hook. This kind of garment hanger has the disadvantage that it is quite difficult, for instance, to slide the individual trousers onto the various carrying bars, or to remove them therefrom, without having them entangled each time with the garments which are already hanging there. Thereby, the individual bars are connected, via a rod connecting the ends of all bars and running at a right angle with respect thereto, whereby the carrying element with the suspension is affixed thereto somehow as an extension.

The hanging of the garments can be simplified when the carrying element itself is bow-shaped and connected with the rear connection rod through a hinged joint. The totality of the carrying bars, five at the most, can then be swung vertically for storing, or horizontally for the removal or hanging of the individual garments. This hinge or swivel joint is self-locking, in order to keep the carrying element in the vertical position while the trousers, for instance, are inserted. When the trousers are inserted, the assembly of carrying bars only has to be swung into the vertical position, so that they require very little space in the closet.

However, even in this kind of garment hanger, the disadvantage of the difficulties in the insertion or removal of the garment in the case of several carrying bars persists, since there is very little space available for these operations. So, for instance, the trousers are to be literally inserted, which is made difficult due to the fact that these carrying bars are coated with an antislip plastic, in order to prevent the sliding of the trousers after they have already been inserted. Due to these problems, usually not all five, but only two or three of the carrying bars forming the assembly are mostly put to use. Accordingly, the actual use is minimal, when compared to the intended purpose of the device.

From German Laid Open Patent Appln. No. 17 78 353.8 a garment hanger is known which is horizontally extendible, whereby the upper part of the hanger, for instance, is guided through corresponding eyes, which are fastened in the top of the closet. On the lower part of the hanger, trousers are a similar garment can be supported. It is advantageous that this arrangement requires a counterweight, in order to keep the hanger in a horizontal position, when it is either provided or not provided with a garment. From such a hanger it is not possible to make, without any further modifications, a multiple coat hanger, which can then be simply hung on a cloth bar in a closet, or on any other object, such as a door of a closet.

Other hanging devices which are not specifically intended for hanging trousers or the like are disclosed in U.S. Pat. Nos. 1,966,283; 2,480,327; 2,604,999; 2,699,263; 2,714,965; 3,187,904; 3,212,647; 3,456,807; and 3,782,559.

A prior art multiple clothes hanging device is also disclosed in U.S. Pat. No. 4,308,962. The device disclosed therein includes a rigid bar member having holes therein for the receipt of several coat hangers or the like. Each end of the rigid bar is supported by a hook configuration. The length of the bar and the length of the hooks are such that, when the hooks are aligned one toward the other and generally along the length of the rigid bar, it is possible for both of the hooks to be simultaneously grasped by one human hand, in order to be able to hold the rigid bar in the one hand by the hooks, as each of a plurality of coat hangers are capable of being individually inserted in each of the holes of the rigid bar. Being able to hold the rigid bar by one hand in this manner facilitates the installation of hangers thereon and is especially convenient if the rigid bar is used as a clothes hanger support for various garments when travelling or the like.

However, the device is shown in U.S. Pat. No. 4,308,962 includes a number of features which tend to make its use difficult for the desired purpose of conveniently hanging a plurality of garments thereon. Specifically, while the hooks are configured for substantially 360° rotation about the end of the rigid bar, the offset manner of providing such rotation tends to cause the bar to be supported at an angle when both or only one of the hooks is being used. Such an offset configuration prevents the rigid bar from hanging directly vertical, when only one of the hooks is being employed, so that the hangers and the garments thereon do not hang in direct vertical alignment. Such misalignment of the rigid bar can also make removal of individual hangers more difficult.

Additionally, the ability to rotate through 360° does enable possible alignment of the hooks for gripping in one hand, but also tends to make it more difficult to insure a stable alignment toward each other, since each of the hooks may freely rotate out of alignment when trying to grasp them at the same time in one hand.

Additionally, the preferred embodiment disclosed in U.S. Pat. No. 4,308,962 does not appear to be constructed in a manner for convenient assembly, convenient use or for reliable operation over an extended period of time. For example, the preferred rigid bar therein appears to be made of metal and is stamped to provide the clothes hanger holes therein. The holes for receipt of clothes hangers are quite small and alignment, and receipt of coat hangers or clothes hangers in a dark or crowded closet could be quite difficult. Additionally, each of the hooks appears to be formed of metal and includes a metal shaft portion for receipt in pivot holes at the ends of the rigid bar. However, the installation requires the shaft to be inserted in the holes and then swagged at each side of the rigid bar for retention in the holes in the ends of the rigid bar. Such assembly requiring swagging of the metal shaft portion of each of the hooks is inconvenient and results in a configuration which would clearly not guarantee effective and reliable pivotable support for the hooks. There is some doubt that the hooks will continue to freely rotate and properly support the rigid bar over an extended period of time.

Accordingly, there remains a need for a support rod for supporting a plurality of hangers for various garments which is simple to use, simple to assemble, and insures effective operation over an extended period of time.

OBJECTS OF THE INVENTION

It is the object of the invention to create a multiple garment hanger, wherein the hanging and removal of the garments are facilitated and are possible without removing the entire garment hanger from the place where it is suspended, whereby the garment hanger assembly tends to remain hanging in its horizontal position.

It is another object of the invention to provide a multiple garment hanger which can be conveniently removed from the clothes hanger bar for the installation of garments thereon. Such a hanger can be conveniently removed from a clothes hanger bar for travel purposes, while being configured to insure proper alignment of garments thereon in a vertical position and convenient means for installing clothes hangers in the holes thereof when supported in a horizontal position.

SUMMARY OF THE INVENTION

The problem is solved in accordance with the invention due to the fact that two or more of the carrying bars are telescopically mounted in the carrying element, in such a manner as to insure a limited horizontal mobility and a capacity to rotate around their respective longitudinal axes.

With such a garment hanger it is possible each time to hang up or to remove any one of two or more garments, preferably trousers, without hindering each other, whereby each time the respective carrying bar is pulled out, which is possible due to their telescopic construction. Thereby, the respective carrying bar with the hanging trousers, which remains in the storage position, acts advantageously as a counterweight for the carrying bars which are extended to their usable length, i.e. the carrying bars which have been extended from the storage position into the garment-receiving position. After the removal and hanging of another pair of trousers, or even without the trousers, the carrying bar is then brought back to its initial position, i.e. the storage position, so that again the compact package of more than two carrying bars is reestablished. An extension of the telescope which is too long with respect to the telescopic carrying bars is prevented, since stops are provided at the ends, which simply and efficiently prevent a second or further extension. Since every carrying bar is by itself swingably supported in the carrying element, the hanging, as well as the removal of garments, is facilitated. In addition, it becomes possible, by simply removing one of the suspension hooks, to reach a very space-saving position. Generally speaking, the result is an optimally compact garment hanger, having two, five or more usually parallel carrying bars, which, when suspended, for instance, from a clothes hanger bar, can function without any counterweight for the extendible, respectively telescopically slidable carrying bars, since the carrying bars remaining in the storage position, with hanging garments, tend to serve as the respective counterweight.

According to a suitable embodiment of the invention, the carrying bars are so built that, when extended, they lock the remaining carrying bars in the storage position. This is intended to prevent, in the case where one of the carrying bars with a hanging garment has been brought from the storage position into a position for garment removal or garment receiving, the other carrying bars from starting to slide. Accordingly, the entire package is prevented from losing its balance, in a simple and safe manner, since, due to the locking feature, the counterweight function is maintained each time by the bars remaining in the storage position.

A particularly suitable and advantageous embodiment of the invention proposes that the carrying bars be made of two mutually parallel bars, extending at a distance from each other, and connected by a U-shaped portion. One bar is slidably and pivotably guided in the carrying element which is arranged at a right angle with respect to the carrying bar, while the other bar serves as the actual carrying bar for the garment. The carrying bar, according to this embodiment of the invention, includes a U-shape with relatively long legs, whereby the one bar serves for the support of the garment, while the other is slidably and pivotably supported in the carrying element. Accordingly, the U-shaped carrying bar can be adjusted in any desired position, in order to receive a garment or to be brought back to the rest or storage position. Additionally, the group of carrying bars may be swung either in a horizontal plane or in a vertical plane, by bringing entire carrying element into the corresponding position. It is even more advantageous, in one preferred embodiment, that the carrying element have two such suspension hooks, whereby in the rest position, only one hook assumes an active position to support the carrying bars, while the second hook is necessary to bring the carrying element into the horizontal plane, in order to telescope or respectively slide back and forth the individual U-shaped carrying bars in accordance with the above description.

A particularly good telescoping effect is achieved when the carrying element includes a solid rod or support and is equipped with several, preferably five, equidistanced bores for the carrying bars or the like. With such an embodiment, a secure guiding support for the upper rod of the U-shaped carrying bars in the carrying element is created, so that a tilting or an uneven load during extension or retraction, and thereby telescoping, cannot occur. Due to the preferred or given distance between the individual bores, a balanced load of the carrying elements is ensured, even when only some of the carrying bars slidably mounted thereon are weighted down by garments. It appears to be particularly advantageous to use five such carrying bars, because, with such an embodiment, an optimal load distribution on the carrying element can be achieved.

It has been previously explained that the carrying element has either a centrally located and mostly swingably mounted suspension hook, or two suspension hooks, whereby, according to the invention, the carrying element has suspension hooks suitably arranged at both ends with openings facing in the same direction and swingably supported in the carrying element. Due to this swingability, it becomes possible to bring the carrying element from the horizontal into the vertical position, when one of the hooks is disengaged. The arrangement of the suspension hooks at the extremities facilitates their handling, since this way the hooks are easily accessible and, due to the same openings, respectively identically shaped hook openings can be easily slipped over the clothes hanger bar of the closet. The carrying element can be brought into the horizontal position and the slidably arranged carrying bars thereon can be shifted from one position into the other, for instance, in order to remove or hang respective garments thereon.

In order to maintain the balance of the entire system, with the retracted telescopes as well as with an extended telescope according to the invention, the suspension hooks are, in one embodiment, mounted in or on the carrying element and are offset in the direction of the U-shaped portion of the carrying bars. This design makes it possible to arrange the suspension hooks exactly where they optimally maintain the balance of the entire system, without any modifications of the actual garment hanger. It is also conceivable that the extensions or portions of the carrying element which are intended to receive the suspension hooks can be arranged slidably or telescopically, in order to properly balance the center of gravity of the system each time it is altered during use.

The length of the upper bar establishes the telescopic path, whereby the stop member is located at the end of the bar, namely, the upper bar. In order to also make possible a precise location on the opposite side of the carrying element, and to precisely establish the entire sliding path, in one embodiment the lower bar and the U-shaped portion are covered with a plastic layer, and the stop member is formed on the free end of the upper bar. Accordingly, the limit or edge of the plastic layer, and the projection formed thereby, constitutes the second limit of the sliding path. A special arrangement or configuration in this area is therefore not necessary.

In one preferred embodiment, the assembly, i.e. the insertion of each upper bar in the carrying element, within the provided bores therein, is possible because of the arrangement of the stop member at the free end of the upper bar. The stop member is an annular thickening of the upper bar and a slot-shaped notch, which extends over the stop member, is provided in the bar. The two end portions in the area of the slot-shaped notch can be pressed together during the insertion, so that the bore can be traversed easily, and then, after the bore has been traversed, they can be extended again through spring action to create the effective stop member. Any intended retraction of the upper bar through the bores is only possible when the two terminal portions are pressed together in the area of the thickening. As a result, over-extension of the carrying bars of the garment hanger is prevented.

An optimally tight fitting, under load, of the individual carrying bars on the carrying element is made possible, according to one aspect of the invention, by the fact that the carrying element has bow-shaped grooves between the individual bores. The grooves are at least on one side and run parallel to the bores. When only one of the suspension hooks is hung on the clothes hanger bar and the carrying element is pivoted accordingly, the individual carrying bars fit advantageously in these grooves and provide the entire system with an advantageously uniform load distribution. The preferred fit of the carrying bars occurs when the grooves are shaped to correspond to the lower bars and arranged to correspond to the distance between the upper and the lower bars.

A telescopic effect can be doubled in a certain sense, according to a further embodiment of the invention, due to the fact that the upper bar is extended beyond the U-shaped portion and the lower bar can be provided with a suitable recess to be slidably mounted thereon. Accordingly, the lower and the upper bars cooperate to form a genuine telescope. The lower bar is tubular for this purpose, while the upper bar is still suitably made of a solid material as before. Naturally, it is conceivable to make the system work only with this genuine telescopic bar, but the balance of the system might be somewhat harder to maintain. In the case of the "double telescopability," it is especially advantageous to provide the corresponding weight balance.

According to another aspect of the invention, the suspension hooks can also favorably influence the weight balance by being shaped like an arc of a circle and having a hook opening located underneath the center of the circle. As a result, a safe suspension is always insured, without unintended slippage of individual garments, when the load is uneven. Moreover, the individual suspension hook will oscillate or swing on the clothes bar of the closet, so that the desired uniform position of the entire garment hanger will be insured.

A garment hanger according to the invention can also be used for the hanging and storing of skirts, whereby, towards the ends of the lower bar, on its underside at the respective ends, open hooks are formed. The slippage of the garments, by removal of the skirt loops from the hooks, is prevented by providing, toward the end of the bar, two or more successive hooks and an arresting projection after the first hook at the end of the bar. The skirts are subjected to a certain prestressing, achieved in a simple manner, by providing a recoil element, preferably a spring, between the extended upper bar and the lower bar, which is arranged so as to surround and push against the upper bar. As a result, the lower bar is kept by the spring at its respective maximal length, and the advantageous prestressing is reached.

The suspension from doors and other objects is facilitated by the fact that, in one embodiment of this invention, at least two of the U-shaped bends are extended upwardly and towards the side facing away from the bars to form a door hook, whereby this door hook has an angular shape. The horizontal portion of the door hook can be length-adjustable and prestressed by a spring, so that it is possible to easily adjust the garment hook to the thickness of the object which supports it. To facilitate back-and-forth movement of the carrying bars, a handle is provided surrounding the U-shaped bends, on the one hand, and at the free end of the lower bar, on the other hand. The handle at the U-shaped bend tends to serve as a stop element at the same time.

The invention distinguishes itself particularly due to the fact that the design of the individual carrying bars considerably facilitates the use of such multiple garment hangers. This is due to the fact that each of these individual carrying bars can be displaced in such a way as to allow each other carrying bar to optimally receive the selected garment. The other carrying bars remaining in the storage position create thereby the counterweight which insures that the entire package of the garment hanger is maintained in the optimal horizontal position. After the respective garment has been hung over or from the bar, the loaded carrying bar is returned to its rest position or storage position to form, with the rest of the bars, a common hanging plane. As a result, the hung garments together with the garment hanger occupy very little space in the closet. The novel garment hanger can be used for the hanging of two to five pairs of trousers, as well as for the hanging of the same number of skirts or the like. The hanging of the skirts is simply achieved through correspondingly arranged bent hooks, formed on the lower bar. In addition to easy handling, it is advantageous that the individual garments can be stored very close to each other, due to the clever arrangement, so that a space-saving arrangement is possible, whereby an easy and safe handling is always a prerequisite.

In yet another aspect, the invention features an improved multiple garment hanging device for simultaneously hanging and storing several articles of clothing or the like on a clothes hanger rod. The garment hanging device includes a rigid bar having a plurality of holes extending therethrough for receipt of clothes hanging elements therein. A pair of hooks are pivotably mounted at opposite ends of the rigid bar. The pair of hooks are substantially alignable toward each other for being held by a human hand for supporting the garment hanging device at least during insertion of the clothes hanging elements in the holes of the rigid bar. The rigid bar has a central plane and a longitudinal axis lying within the central plane. The plurality of holes are separated one from the other and displaced along the longitudinal axis. Each of the holes extends substantially perpendicular to the central plane. The rigid bar has a first transverse dimension within the central plane with the first transverse dimension being perpendicular to the longitudinal axis at each of the holes. The rigid bar has a second transverse dimension within the central plane with the second transverse dimension being perpendicular to the longitudinal axis in an area thereof between the holes. The first transverse dimension is greater than the second transverse dimension. The rigid bar has a pivot hole at each of the opposite ends thereof. The pivot hole extends substantially perpendicular to the central plane. Each of the pair of hooks lies substantially along a circle, with the circle having a center. Each of the pairs of hooks extends along a substantial portion of the circle to have a free end and a pivot end. The pivot end of the hook has a pivot axis. The pivot axis is disposed within the pivot hole of the rigid bar with the center of the circle of the hook being located within the central plane of the rigid bar during relative rotation of the pivot axis within the pivot hole. The hook has a first bearing member substantially at one side of the pivot axis and a second bearing member substantially at the other side of the pivot axis. The rigid bar has a first side and a second side which are substantially parallel with the central plane. The first bearing member includes an annular surface substantially perpendicular to the pivot axis for bearing against the first side of the rigid bar at the pivot hole. The second bearing member is disposed against at least a portion of the second side of the rigid bar at the pivot hole. The pivot axis includes at least one slot at the second bearing member for biased inward deflection of the second bearing member for having provided means for inward deflection of the second bearing member during insertion of the pivot axis in the pivot hole during assembly. The central plane extends vertically below the clothes hanger rod when both of the hooks are engaged with the clothes hanger rod and when only one of the hooks is engaged with the clothes hanger rod.

BRIEF DESCRIPTION OF THE DRAWINGS

Further details and advantages of the invention are provided in the following description of the drawings, wherein several preferred embodiments, with the required details and components, are illustrated.

DESCRIPTION OF THE PREFERRED EMBODIMENTS

Figure 1:
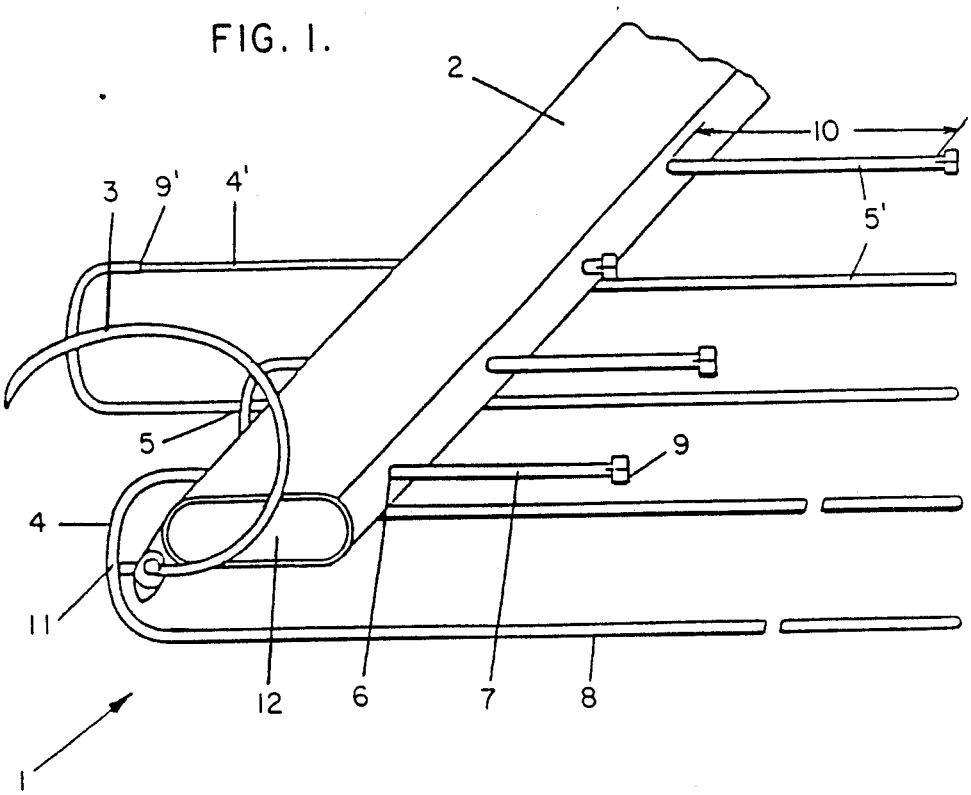
FIG. 1 is a perspective view of a preferred garment hanger built as a multiple garment hanger.

FIG. 1 shows a garment hanger 1, in a perspective view, wherein the carrying element 2, which is built as a generally rectangular rod 12, runs centrally of the hanger 1. The carrying element 2 has suspension hooks 3 at both ends with only one of them being shown in FIG. 1. Several carrying bars 4, 4', 5, 5' are slidably mounted in the carrying element 2. The carrying bars 4, 5, 5' are shown in a position for favorably receiving garments thereon, while the carrying bar 4 is in a rest position, i.e. after a corresponding garment, preferably a pair of trousers, has been hung thereon.

The carrying bars 4, 4', 5, 5' are slidably and pivotably mounted in bores 6 in the carrying element 2, so that each carrying bar 4, 4', 5, 5', consisting of an upper bar 7 and a lower bar 8, can each be brought together with the carrying element 2 into a rest position or an active position.

The hanging and/or removal of the garments is considerably facilitated by the carrying bars 4, 4', 5, 5' acting as telescopes with respect to the carrying element 2. The individual carrying bars, and in particular the upper bars 7 thereof, are prevented from completely sliding out or from sliding too far by stop elements 9 located towards the end of the upper bar 7. The stop element 9 and the stop element 9' on the opposite side of the bar 7 limit and define a telescopic travel path 10 so that the optimal position of the hanger is preserved, independently of the position of each other individual carrying bar 4, 4', 5, 5' at any given moment.

The upper bar 7 and the lower bar 8 are joined together by a connecting U-shaped portion 11 to form a stable assembly, which can be moved back and forth along the upper rod 7, through the bores 6 in the rod 12, which is made of solid material to form the carrying element 2. Due to a corresponding width of the preferred rod 12 and its being made of a solid material, a secure support of the carrying bars 4, 4', 5, 5' is ensured, independently of their respective positions.

Figure 2:
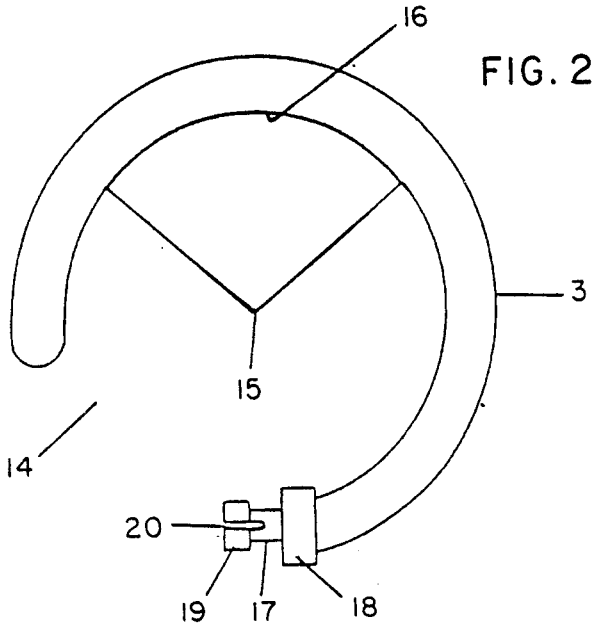
FIG. 2 is a side view of a suspension hook including various features of the invention.

FIG. 2 shows a preferred suspension hook 3 of the carrying element 2, in order to show clearly that the suspension hooks 3 also provide particular features of the invention. As shown in FIG. 2, the suspension hooks 3 are circularly designed, with one circle or arcuate segment cut out for the hook opening. The hook opening is located below the center 15 of the circle in order to prevent the garment hanger 1 from inadvertently sliding or falling off the clothes hanger bar gripped by the hook 3. On the inner edge or top of the suspension hook 3, a load area 16 is preferably suitably smooth, in order that the suspension hook 3 can optimally balance the load of the garment hanger in the horizontal or vertical position.

For a preferred connection with the carrying element 2, or with a corresponding extension which will be described later, at one end or side of the hook opening 14 a tilt rim or bearing surface 17 is provided. The rim or surface 17 is limited or defined by the slide-in stop element 18 at the inward end thereof and the stop rim 19 on the extended end thereof. The stop rim 19, which is a thickened portion with respect to the tilt rim or bearing surface 17, is provided with a notch 20 which is sufficiently long to extend, at least partially, into the rim or surface 17, in order to create a kind of spring effect. The notch 20 and resulting spring effect facilitate the insertion into the holes at the end of the carrying element 2 and the subsequent fastening or retention in the carrying element 2. It is advantageous that this notch 20, as it cooperates with the design of the entire arresting means, creates the possibility of pivotably mounting the suspension hook 3 on the carrying element 2 in an effective and simple manner.

Figure 3:
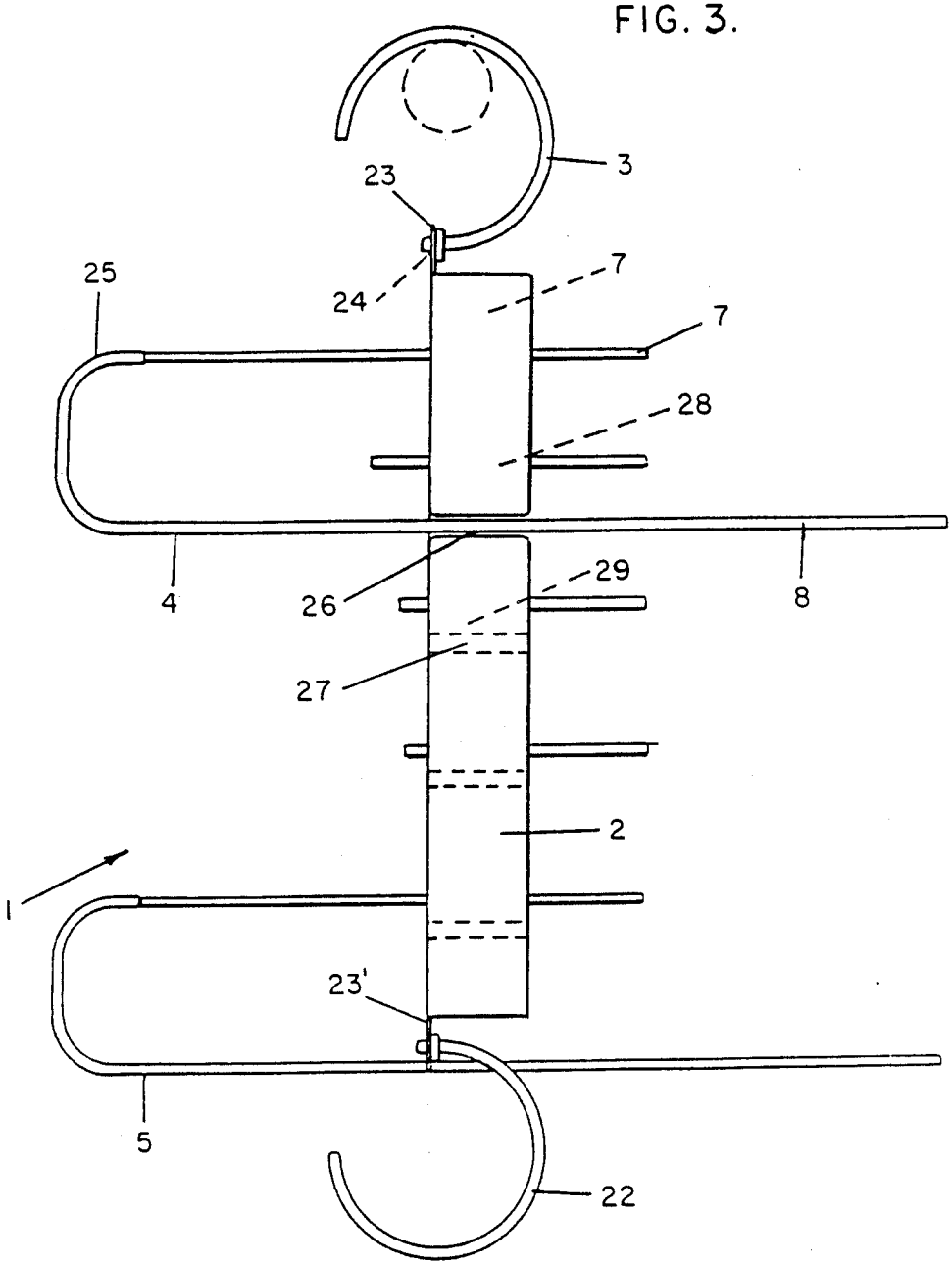
FIG. 3 is a side view of the garment hanger according to FIG. 1, in an at-rest position with only one activated suspension hook.

While FIG. 1 shows the position (generally horizontal) wherein the garment hanger 1 can be loaded with garments or wherein the individual garments can be removed, FIG. 3 shows the rest or vertical position, wherein the entire garment hanger 1 is suspended by only one of the suspension hooks 3 mounted at the ends thereof. As shown, the lower hook 22, however, is not in use, but is disposed for possible use when the garment hanger 1 is brought in the position shown in FIG. 1.

In the preferred embodiment for hanging pants or dresses, the individual suspension hooks 3, 22 are mounted on laterally offset extensions 23 of the carrying element 2. Each extension 23 is provided with a bore 24 for engaging receipt of the rim or surface 17 of the suspension hooks 3, 22 therein. For the sake of simplicity in the drawings, only two bars 4, 5 of the total of preferably five carrying bars are shown completely, while the others are only partially indicated. It should be clear that each lower bar 8, together with its plastic coating 25, in the position shown in FIG. 3 slides into a groove 26 or 27 formed in the carrying element 2, so that an almost vertical position of the carrying element 2 can be reached. Accordingly, only an optimally reduced space is required.

As seen in FIG. 3, the individual carrying bars 4, 5 are in an intermediate position, i.e. not completely in the rest or storage position, so that they can be slightly pushed to the left. Not represented in FIG. 3 are the extensions on the free ends of the upper bars 7. Although the extensions 23 are shown as being disposed at one side of the lateral edges of the carrying element 2, the extensions 23 can, if required, be even farther laterally offset in order to provide equilibrium for the entire system.

Figure 4:
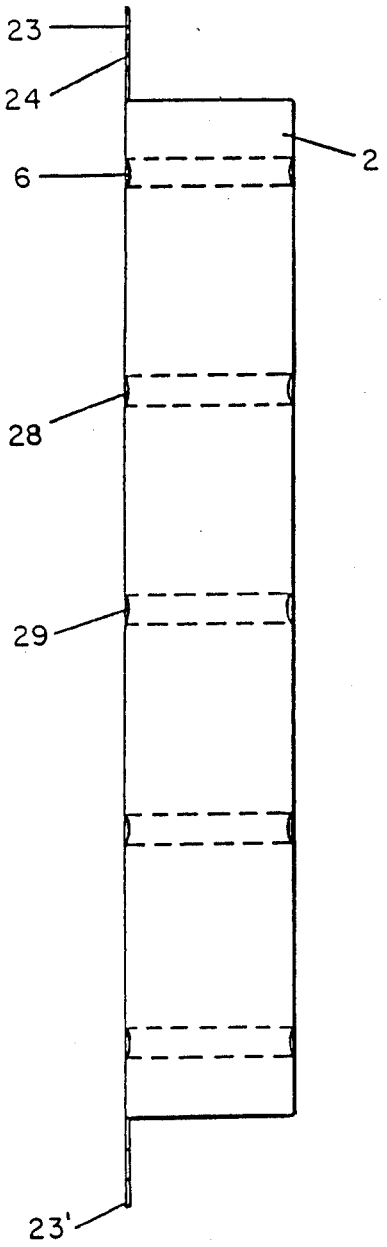
FIG. 4 is a frontal view of a preferred carrying element.
Figure 5:
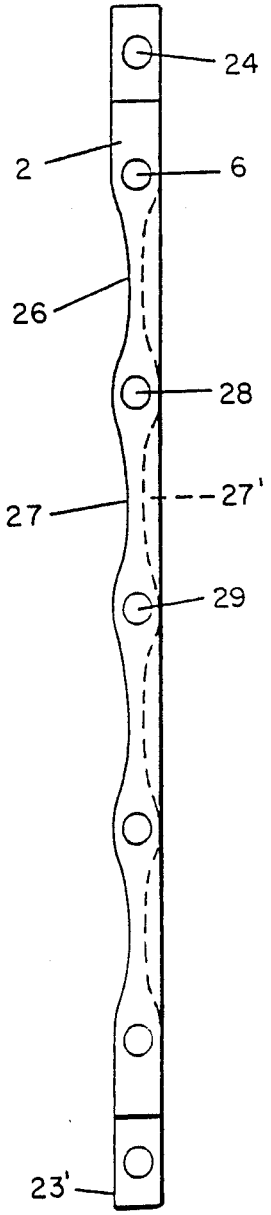
FIG. 5 is a side view of the carrying element of FIG. 4.

The individual grooves 26, 27 each extend or run parallel to the bores 28, 29, 6, as shown in FIGS. 4 and 5, which respectively include in a frontal view and a side view of the carrying element 2. While the grooves 26, 27 according to FIG. 3 are actually a kind of notch, FIG. 5 shows an embodiment, wherein the grooves are correspondingly bow-shaped recesses between the individual bores 6, 28, 29.

Figure 6:
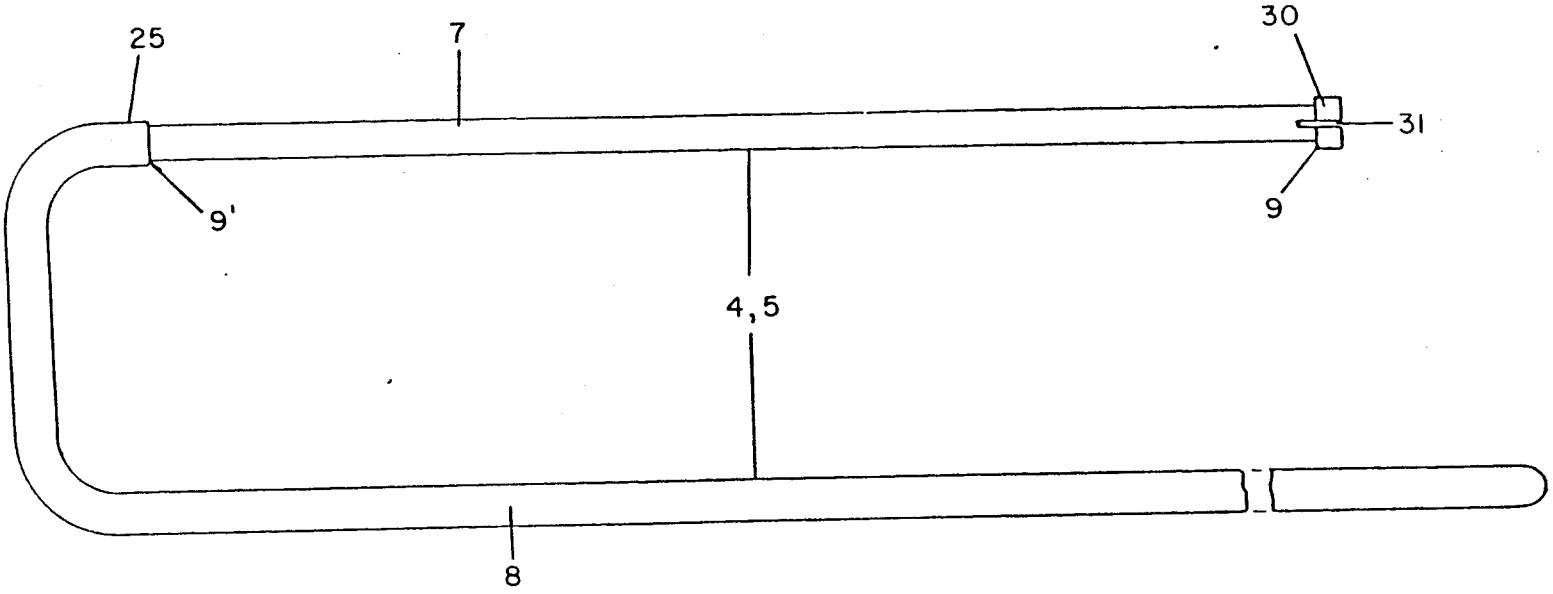
FIG. 6 is a side view of a preferred carrying bar.

FIG. 6 shows one of the carrying bars 4 in a lateral view, to more clearly show that only the U-shaped portion 11 and the lower bar 8 are suitably provided with a plastic coating 25. As a result, in the end area of the upper bar 7, the desired additional stop member 9' is formed, while the necessary stop member 9 is formed at the free end. The stop member 9 is provided by a thickened region 30, in which a notch 31 is provided. The notch 31 makes possible a compression and the insertion into the bores 6, 28, 29 of the carrying element 2. After the insertion and traversing of the bores, the two parts are separated by spring force, so that the desired stop member 9 is created.

For the case where the carrying bar 4, 5 is made in its entirety of a certain plastic material, the desired stop member 9' can be formed by a corresponding thickened area or region, in order to increase the loading capacity with the U-shaped portion 11 and the lower bar 8 having a larger diameter than the upper bar 7.

Figure 7:
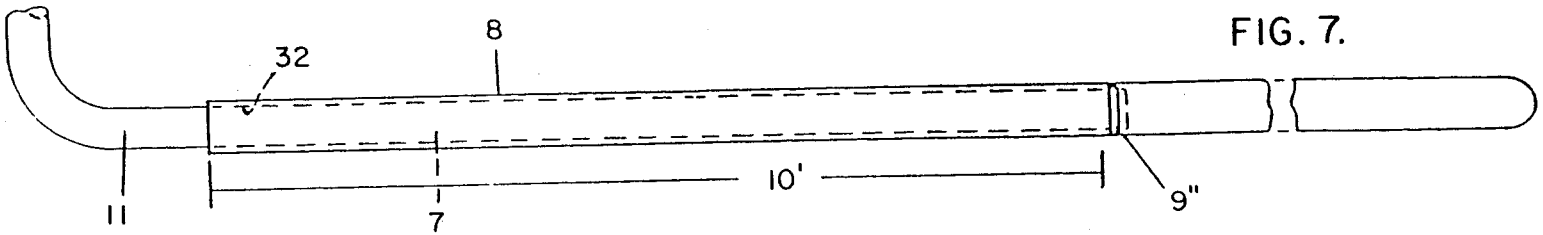
FIG. 7 is an alternative carrying bar with a telescopically mounted lower bar.

FIG. 7 shows a further suitable embodiment, in which the lower bar 8 is additionally or only by itself telescopically constructed. The upper bar 7 is extended through the U-shaped portion 11 so that the lower bar 8, when provided with a corresponding recess 32, can slide on top of it. In this embodiment, a stop member 9'' can be provided to effectively limit the telescopic travel path 10.

In the embodiment shown in FIG. 7, depending on the expected load, it is possible to bring the entire carrying bar 4 toward the loading position by correspondingly adjusting the upper bar 7 in the carrying element 2. Additionally or alternatively, it would be possible, under certain circumstances, to employ the telescopic travel path 10 according to FIG. 7. As a result, it is also possible to use both telescopic travel paths, or telescopic travelpath segments 10, 10', in order to create a widely extensible embodiment to facilitate the hanging of individual garments. In such a situation, the lower bar 8 might be pushed back first and, subsequently, the entire carrying bar 4 could be returned to the storage position.

Figure 8:
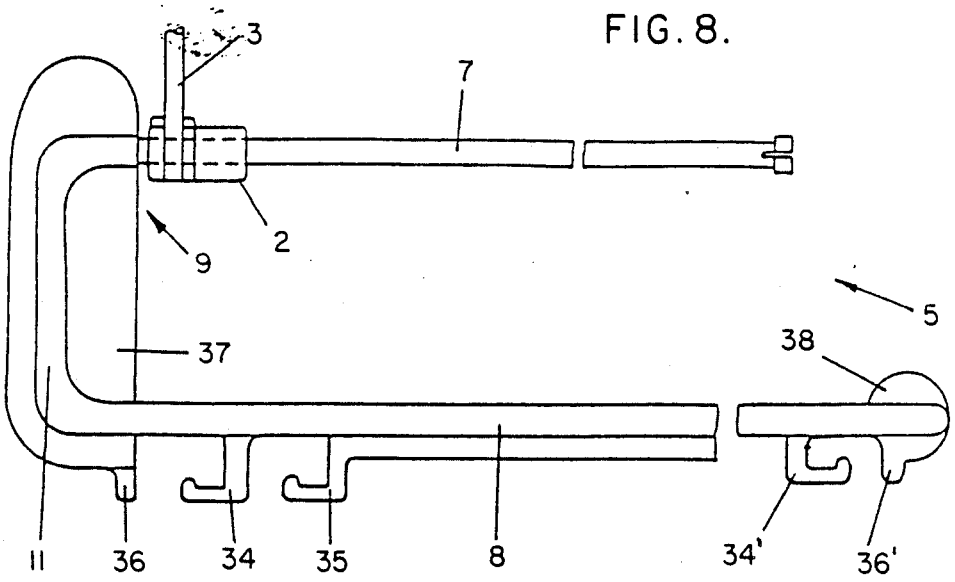
FIG. 8 is a side view of an alternative carrying bar with hooks formed thereon, for the hanging of skirts.

The embodiment illustrated in FIG. 8 is remarkable primarily due to its higher stability because of the particular configuration of the U-shaped portion and of the lower carrying bar. In order to also make possible the simple hanging and arranging of skirts on the garment hanger, on each of the lower bars 8, hooks 34, 35, 34' are formed. The groups of hooks 34, 35, 34' are open towards opposite sides, respectively, towards the ends of the lower bar 8, so that the opening of the respective first hooks 34, 34' are limited by arresting dogs 36, 36'. Once hung up, the garments cannot slip off the hook easily because of the adjacent hooks or the arresting dogs.

Essentially, the special configuration of the U-shaped portion 11 of FIG. 8 does not serve to increase the stability of the entire system, but rather functions as a handle 37 for the extension and retraction of the bars 7, 8. The free end of the carrying bar 8 is also equipped with a similarly shaped handle 38. Both handles 37, 38 are equipped with an arresting dog 36 which has already previously been described, while the handle 37 serves at the same time as a stop member 9.

Figure 9:
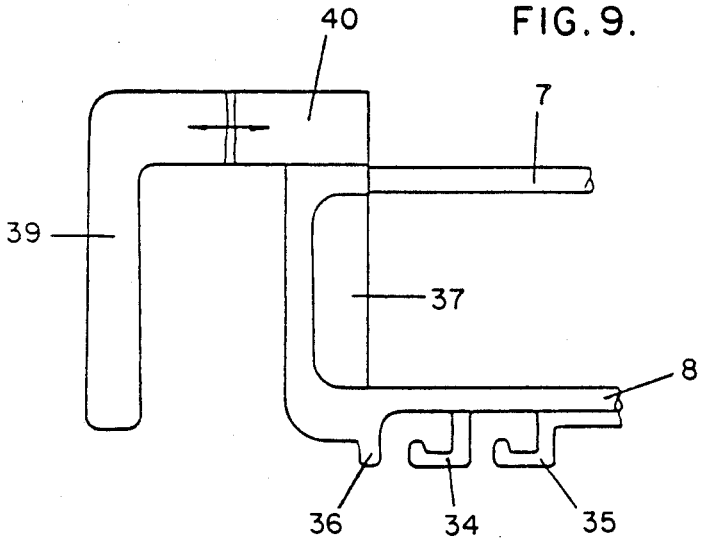
FIG. 9 is a view of a door hook formed on the rear end of a carrying bar.

FIG. 9 shows an additional embodiment in which the U-shaped portion 11 is prolonged and squared to create a door hook means, such as an angular door hook 39. In the embodiment seen in FIG. 9, the horizontal web 40 is extensible, so that an optimal adjustment to the object on which the garment hanger 1 is supposed to hang is possible. It is sufficient, for instance, in a hanger having five such carrying bars 4, 5, for only two to have corresponding door hooks 39.

Figure 10:
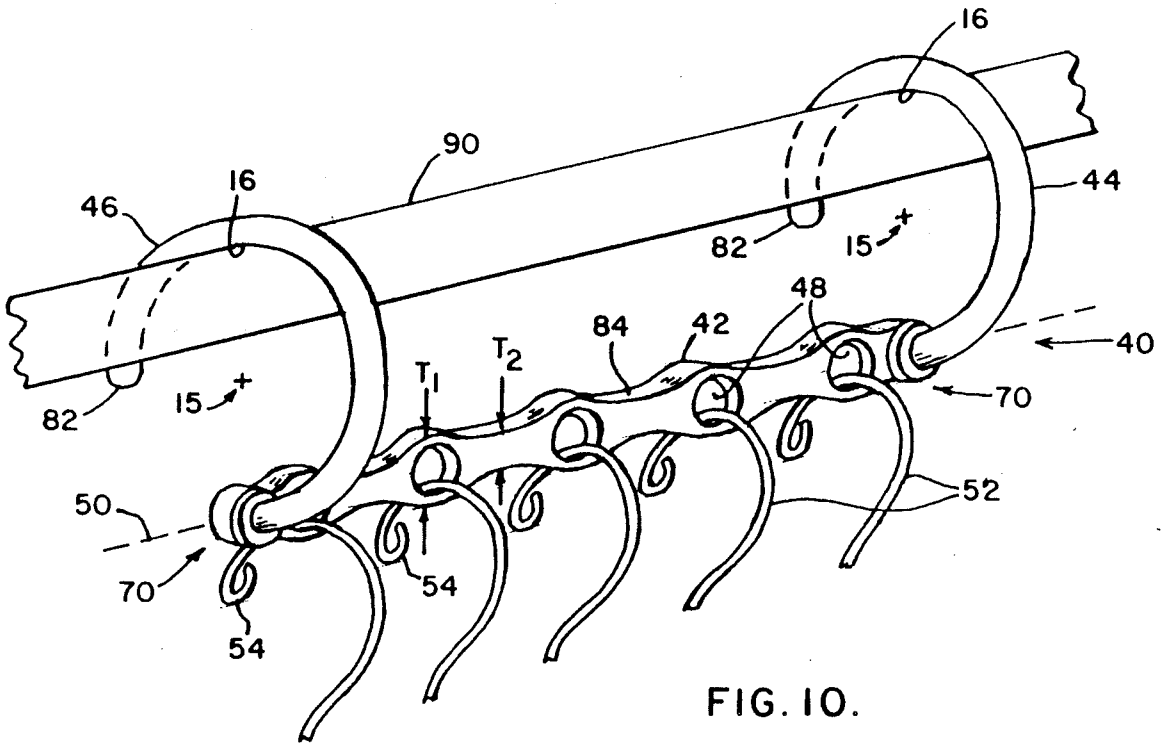
FIG. 10 is perspective view of another preferred garment hanging including various features of the invention.

As seen in FIG. 10, an alternative garment hanger device 40 is installed on a clothes hanging bar 90 and includes a rigid bar member 42 with hooks 44 and 46 respectively pivotably mounted at the opposite ends thereof. The rigid bar 42 includes a plurality of holes formed along the longitudinal axis 50 of the rigid bar 42. The holes 48 are evenly spaced along the longitudinal axis 50 for the receipt of each of a plurality of coat hanger elements 52 therein. The coat hanger elements 52 preferably include an enlarged end 54 and are of the type which are generally used for hanging suits or the like.

Figure 12:
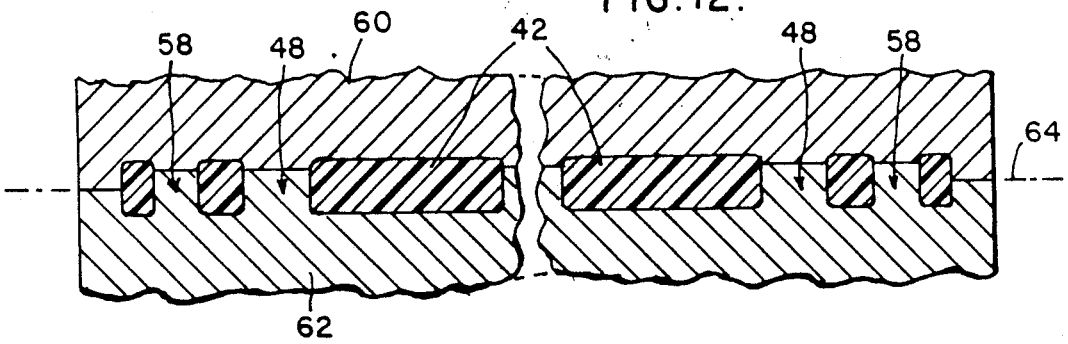
FIG. 12 is a sectional view of the preferred method of molding the rigid bar of the garment hanging device.
Figure 13:
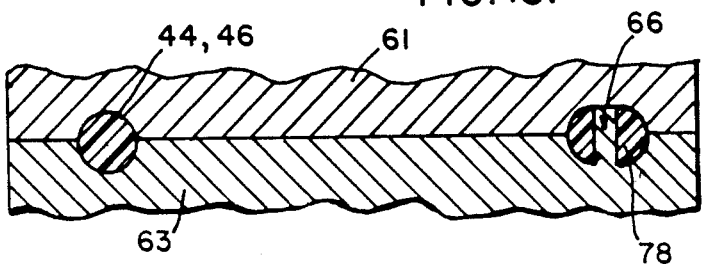
FIG. 13 is a sectional view of the preferred method of molding the hook of the garment hanging device.

As seen in FIGS. 12 and 13, the preferred rigid bar 42 and the preferred hooks 44, 46 are both formed of strudy, slightly deflectable plastic material. The rigid bar 42 is preferably molded between a pair of molding dies 60, 62. The molding dies 60, 62 cooperate to generally mate at the central plane 64 of the rigid bar 42 for the formation of the holes 48 and the pivot holes 58 for eventual receipt of the hooks 44, 46 therein. As will be seen, in order to provide proper balance and alignment of the preferred garment hanging device 40, the holes 48 and the pivot holes 58 extend perpendicular to the central plane 64 of the preferred rigid bar 42. As a result, formation of the preferred rigid bar 42 in this manner provides the holes 48 and the pivot holes 58 in proper alignment and with smooth interior surfaces for the respective receipt of hanger elements and the pivot axis of the hooks therein.

As seen in FIG. 13, the preferred hooks 44, which are identical to the hooks 46, are preferably formed of the same type of strudy but slightly deflectable plastic material as is the rigid bar 42. An upper mold 61 and a lower mold 63 cooperate to provide various features for the hooks 44, 46. The hooks 44, 46 are preferably similar to the hooks 3 shown in FIG. 2 and discussed hereinabove. Molding the preferred hooks 44, 46 (and the hooks 3) as shown in FIG. 13 provides a simple means for providing a slot 66 at the pivot end of the hook. As will be seen, the use of such a slot 66 simplifies installation of the hooks 44, 46 in the pivot holes 58 of the rigid member 42 and insures proper retention therein throughout the expected use of the garment hanging device 40. The slot 66 in similar to the slot 20 of the hook 3 shown in FIG. 2 and in generally formed in the pivot axis 68 at the pivot end 70 of the hook 44, 46.

The pivot axis 68 is dimensioned to be received within the pivot hole 58 of the rigid member 42. A first bearing member 72 is also formed at the pivot end 70 of the hook 44, 46 for providing a radial bearing surface 74 for smooth, sliding contract against a first side 76 of the right bar 42 around the pivot hole 58. A second bearing member 78 on the opposite end of the pivot axis 68 is configured to bear against the other side 80 of the rigid bar 42 around the pivot hole 58. Preferably, both the first side 76 and the other side 80 of the rigid bar are substantially parallel with the central plane 64 thereof.

Figure 14:
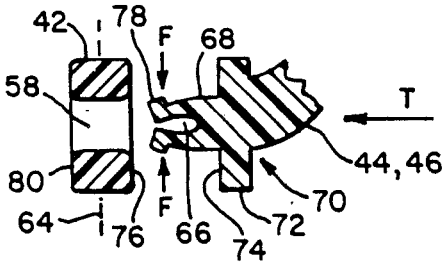
FIG. 14 is a sectional view of the preferred method of assembling the hook in the pivot hole of the rigid bar.

As seen in FIG. 14, the hook 44, 46 is inserted in a direction as indicated by the arrow I as an outside force F is applied to the second bearing member 78 to inwardly deflect the slot 66. Deflection of the second bearing member 78 in this manner reduces the dimensions of the second bearing member 78 to allow insertion of the pivot axis 68 within the pivot hole 58. Clearly, although not preferred, other forms of single or multiple slot configurations could be employed to proide the desired inward deflection.

Figure 15:
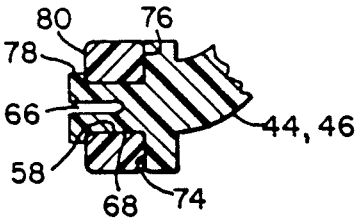
FIG. 15 is a sectional view of the hook installed in the pivot hole of the rigid bar.

As seen in FIG. 15, upon insertion of the pivot axis 68 within the pivot hole 58, the biased characteristics of the plastic causes the slot to expand, thereby disposing the second bearing member 78 against the side 80 for retention of the hook, 44, 46 in the hole 58. As also seen in FIG. 15, the relatively large radial bearing surface 74 provides significant stabilizing contact with the first side 76 of the rigid bar 42 around the pivot hole 58 to maintain proper alignment of the hook 44, 46 relative to the rigid bar 42.

Formation of the preferred rigid bar 42 and the hooks 44, 46 of plastic in the manner described hereinabove tends to insure continued, reliable operation of the preferred garment hanger over an extended period of time. The preferred plastic, as mentioned above, in rigid yet deflectable for facilitating assembly in the manner described hereinaboe. Additionally, the preferred plastic may also include a relatively low coefficient of friction to allow smooth, relative movement of the pivot axis 68 within the pivot hole 58 and of the radial bearing surface 74 against the side 76 about the pivot hole 58. The use of a plastic having a relatively low coefficient of friction will also be seen to be advantageous for providing a proper surface on the interior of the holes 48 for the receipt of various hangers 52.

As discussed above with respect to FIG. 2, the preferred hook 3, and thus the preferred hooks 44, 46, are generally disposed so as to lie within the arc of a circle having a center 15, shown in FIGS. 2 and 10. The free or extended end 82 of the hook 44, 46 is preferably located, as seen in FIG. 10, below the center 15 of the hook 44, 46. Clearly, such a location of the extended end 82 may not be required, but the angular extension of the hook 44, 46 from the pivot end 70 to the extended end 82 should be at least as much as 240° to 270° and preferably greater than 270° of the circle extending about the center 15.

As seen in FIG. 10, it should now be clear that the type of pivot axis 68 and pivot hole 58 as described hereinabove provide each of the hooks 44, 46 with an alignment which disposes the center 15 within the central plane 64 of the rigid bar 42 throughout relative rotation of the pivot axis 68 within the pivot hole 58. Additionally, the preferred alignment allows a point 16 on the hooks 3, 44, or 46 to rest against the top of the clothes hanger bar 90. The point 16 is preferably aligned with the center 15 and with the pivot axis 68. Accordingly, the point 16 will thereby also remain within the central plane 64 throughout the complete pivoting of the hook.

As the hooks 44, 46 are disposed toward each other (with hook 44 rotated to the left and hook 46 rotated to the right, as generally viewed in FIG. 10), each of the hooks 44, 46 will tend to lie on top of the upper surface 84 of the rigid bar 42. With each hook 44, 46 lying against the upper surface 84 in this manner, grasping of the hooks 44, 46 in a single hand is simplified. By contrast, the angled, misalignment of the hooks of U.S. Pat. No. 4,308,962 may allow full 360° rotation but does not therefore provide a convenient means for aligning the hooks toward one another for simple grasping by one hand. As will be seen, the general misalignment of the hooks in this manner will also tend to cause the rigid bar thereof to be misaligned when utilizing either both or only one of the hooks.

Additionally, as seen in FIG. 10, the previously discussed alignment of the pivot axis 68 and the pivot hole 58, which causes the center 15 and the point 16 to be disposed within the central plane 64 of the rigid bar 42, ensures that the rigid bar 42 tends to remain in a vertical position as generally shown in FIG. 10. Such vertical alignment of the central plane 64 facilities insertion of each of the hangers 52 in its corresponding hole 48. With the preferred rigid bar 42 being provided with some thickness for support of the hangers therein, the non-vertical, angled disposition of the rigid bar by the hook configuration disclosed in U.S. Pat. No. 4,308,962 would significantly complicate insertion of the hangers 52 in the holes 48.

Figure 11:
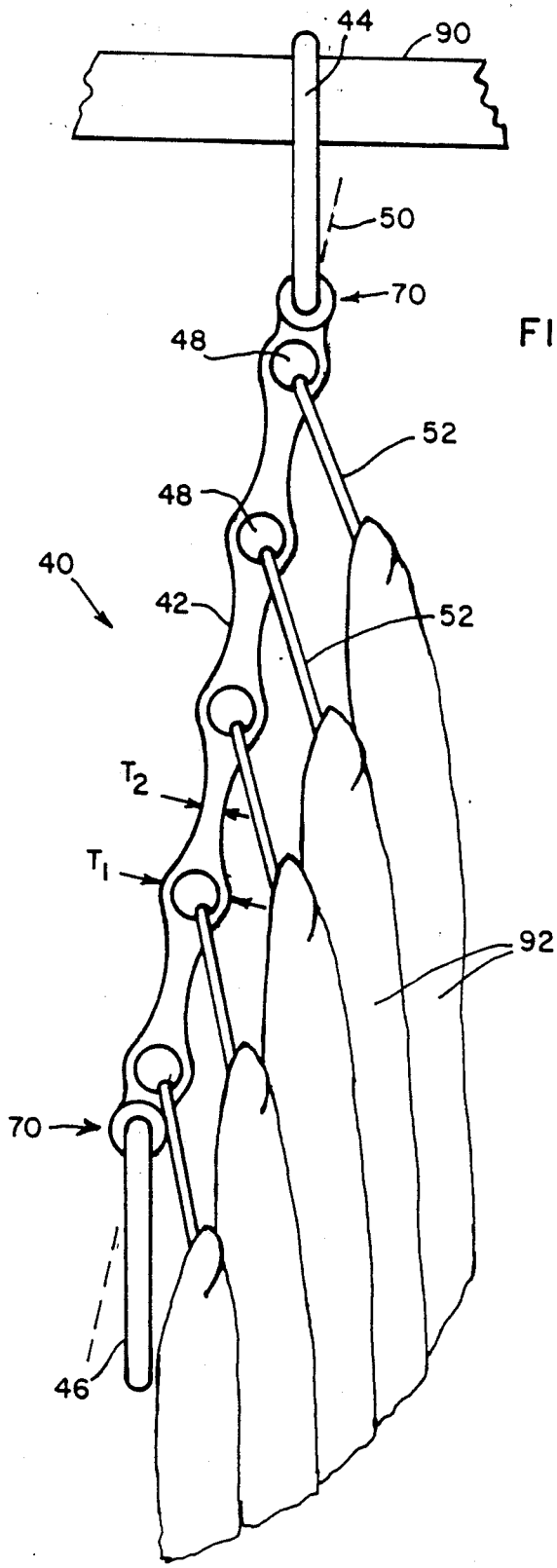
FIG. 11 is a plane elevational view of the garment hanging device of FIG. 10 with only hook being mounted on a clothes hanging bar and including a plurality of garments on suit hangers supported in the holes of the garment hanging device.

The preferred rigid bar 42 includes another feature, as seen in FIG. 10 and FIG. 11, to facilitate insertion of a hook 52 in a hole 48 in a crowded or darkened closet. Specifically, the rigid bar has a first transverse dimension T1 which is in the central plane 64 and is generally prependicular to the longitudinal axis 50 at each of the holes 48. Additionally, the rigid bar 42 has a second transverse dimension T2 which is in the central plane 64 and is perpendicular to the longitudinal axis 50 in the area thereof between each of the holes 48. With the transverse dimension T1 being larger than the transverse dimension T2, location of each of the holes 48 for insertion of a hanger is simplified even in a darkened or crowded closet. By making the transverse dimension T1 greater than the transverse dimension T2, the size of each hole 48 may also be enlarged to readily receive hangers 52 of the type which are used on suit or dress coats and which have the enlarged ends 54.

In the configuration shown in FIG. 11, the preferred garment hanger device 40 is being hung on the clothes hanger rod 90 by only the support hook 44 thereof. The clothes hangers 52 are again of the larger and contoured type typically used for suit or dress coats to allow a slight separation of each of the coats 92 which are hung thereon. Accordingly, with the use of asymmetrical hangers 52, the preferred garment hanger device 40 may hang generally downwardly from one hook 44 at a slightly angle (as seen in FIG. 11) to allow a more relaxed support of each of the coats 92 thereon. However, this slight angle, as seen in FIG. 11, does not prevent the central plane 64 from hanging vertically below the rod 90. With the central plane 64 remaining in the vertical position, the coats 92 thereon remain vertically aligned.

However, with such an angle as is seen in FIG. 11, it should be clear that the device disclosed in U.S. Pat. No. 4,308,962 includes additional disadvantages which would tend to restrict smooth, relatively even alignment of the garments thereon. As previously discussed, the side or angled disposition of the hooks relative to the rigid bar in the device disclosed in U.S. Pat. No. 4,308,962 will cause the rigid bar to hang downwardly from a single hook in an inclined manner. As a result, the upper holes would tend to be disposed forward in the closet and the lower holes rearward in the closet. The "central plane" of the rigid bar of U.S. Pat. No. 4,308,962 would not hang in a truly vertical position when either two hooks or only one hook engages the clothes hanger rod. Accordingly, removal of a lower garment from the device shown in U.S. Pat. No. 4,308,962 would be difficult without completely returning the rigid bar to the horizontal position. However, in the preferred garment hanging device 40 of the present invention, the central plane 64 of the rigid bar 42 (which is parallel to the surface of the drawing in FIG. 11) during the vertical disposition shown in FIG. 11 will remain truly vertical. Accordingly, each of the coat hangers 52 will remain directly above the coat hangers therebelow. As a result, removal of one of coat hangers from its corresponding hole 48 is possible without requiring that the entire rigid bar 42 be returned to the horizontal position by repositioning the hook 46 on the clothes hanger rod 90.

Figure 16:
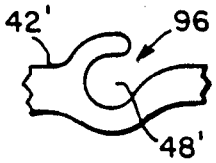
FIG. 16 is a fragmentary view of an alternative hole configuration for the rigid bar of the invention.

As seen in FIG. 16, an alternative hole 48' for the rigid bar 42' includes an opening 96 at one side thereof. Such an opening would allow even easier insertion of a hanger 52 therein. However, the opening 96 would preferably be located at one side, rather than centrally, of the hole 48' in order to securely support a hanger therein when only one hook is used to support the rigid bar 42'. Obviously, with such openings 96, the generally preferred symmetrical configuration of the preferred garment hanging device 40 is lost. As a result, only one and the same hook 44, 46 (that one toward the openings 96) could be used for support of the rigid bar 42' in the vertical position.

Any and all patents and publications, if any, mentioned herein are specifically incorporated by reference as if set forth in their entirety herein.

The invention as described hereinabove in the context of a preferred embodiment is not to be taken as limited to all of the provided details thereof, since modifications and variations thereof may be made without departing from the spirit and scope of the invention.

What is claimed is:

1. An improved multiple garment hanging device for simultaneously hanging and storing several articles of clothing or the like on a clothes hanger rod, said garment hanging device being of the type which includes a rigid bar, said rigid bar having a plurality of holes extending therethrough for the receipt of clothes hanging elements therein, a pair of hooks pivotably mounted at opposite ends of said rigid bar, said pair of hooks being substantially alignable toward each other for being held by a human hand for supporting the garment hanging device at least during insertion of the clothes hanging elements in said holes of said rigid bar, said improvement comprising:

said rigid bar having a central plane and a longitudinal axis lying within said central plane;

said plurality of holes in said rigid bar being separated one from the other and displaced substantially along said longitudinal axis;

each of said holes extending substantially perpendicular to said central plane;

said rigid bar having a first transverse dimension within said central plane, said first transverse dimension being perpendicular to said longitudinal axis at each of said holes;

said rigid bar having a second transverse dimension within said central plane, said second transverse dimension being perpendicular to said longitudinal axis in an area thereof between said holes;

said first transverse dimension being greater than said second transverse dimension;

said rigid bar having a pivot hole at each of said opposite ends thereof; said pivot hole extending substantially perpendicular to said central plane;

each of said pair of hooks lying substantially along a circle, said circle having a center;

said each of said pair of hooks extending along a substantial portion of said circle to have a free end and a pivot end;

said pivot end of said hook having a pivot axis;

said circle having a portion being substantially adjacent to said pivot axis;

said pivot axis being substantially tangential to said portion of said circle;

said pivot axis being disposed within said pivot hole of said rigid bar with said center of said circle of said hook being located within said central plane of said rigid bar during relative rotation of said pivot axis within said pivot hole;

said hook having a first bearing member substantially at one side of said pivot axis and a second bearing member substantially at the other side of said pivot axis;

said rigid bar having a first side and a second side which are substantially parallel with the central plane;

said first bearing member including an annular surface substantially perpendicular to said pivot axis for bearing against said first side of said rigid bar at said pivot hole;

said second bearing member being disposed against at least a portion of said second side of said rigid bar at said pivot hole;

said pivot axis including slot means at said second bearing member for biased inward deflection of said second bearing member for having provided means for inward deflection of said second bearing member during insertion of said pivot axis in said pivot hole during assembly; and said central plane for extending vertically below the clothes hanger rod when both of said hooks are engaged with the clothes hanger rod and said central plane for extending vertically below the clothes hanger rod when only one of said hooks is engaged with the clothes hanger rod.

2. A multiple garment hanging device for simultaneously hanging and storing several articles of clothing or the like on a clothes hanger rod, said garment hanging device comprising:

a rigid bar;

said rigid bar having a plurality of holes extending therethrough for receipt of clothes hanging elements therein;

a pair of hooks pivotably mounted at opposite ends of said rigid bar;

said pair of hooks being substantially alignable toward each other for being held by a human hand for supporting the garment hanging device at least during insertion of the clothes hanging elements in said holes of said rigid bar;

said rigid bar having a central plane and a longitudinal axis lying within said central plane;

said plurality of holes in said rigid bar being separated one from the other and displaced substantially along said longitudinal axis;

each of said holes extending substantially perpendicular to said central plane;

said rigid bar having a first transverse dimension within said central plane, said first transverse dimension being substantially perpendicular to said longitudinal axis at each of said holes;

said rigid bar having a second transverse dimension within said central plane, said second transverse dimension being substantially perpendicular to said longitudinal axis in an area thereof between said holes;

said first transverse dimension being greater than said second transverse dimension;

said rigid bar having a pivot hole at each of said opposite ends thereof;

said pivot hole extending substantially perpendicular to said central plane;

each of said pair of hooks lying substantially along a circle, said circle having a center;

said each of said pair of hooks extending along a substantial portion of said circle to have a free end and a pivot end;

said pivot end of said hook having a pivot axis;

said circle having a portion being substantially adjacent to said pivot axis;

said pivot axis being substantially tangential to said portion of said circle;

said pivot axis being disposed within said pivot hole of said rigid bar with said center of said circle of said hook being located substantially within said central plane of said rigid bar during relative rotation of said pivot axis within said pivot hole;

said hook having a first bearing member substantially at one side of said pivot axis and a second bearing member substantially at the other side of said pivot axis;

said rigid bar having a first side and a second side which are substantially parallel with the central plane;

said first bearing member including an annular surface substantially perpendicular to said pivot axis for bearing against at least a portion of said first side of said rigid bar at said pivot hole;

said second bearing member being disposed against at least a portion of said second side of said rigid bar at said pivot hole;

said pivot axis including slot means at said second bearing member for biased inward deflection of said second bearing member during insertion of said pivot axis in said pivot hole during assembly; and said central plane for extending vertically below the clothes hanger rod when both of said hooks are engaged with the clothes hanger rod and said central plane for extending vertically below the clothes hanger rod when only one of said hooks is engaged with the clothes hanger rod.

3. A multiple garment hanging device for simultaneously hanging and storing several articles of clothing or the like on a clothes hanger rod, said garment hanging device comprising:

a substantially rigid bar;

said substantially rigid bar having a plurality of holes extending therethrough for receipt of clothes hanging elements therein;

a pair of hooks pivotably mounted at opposite ends of said substantially rigid bar;

said pair of hooks being substantially alignable toward each other for being held by a human hand for supporting the garment hanging device at least during insertion of the clothes hanging elements in said holes of said rigid bar;

said substantially rigid bar having a central plane and a longitudinal axis lying substantially within said central plane;

said plurality of holes in said substantially rigid bar being separated one from the other and displaced substantially along said longitudinal axis;

each of said holes extending substantially perpendicular to said central plane;

said substantially rigid bar having a pivot hole at each of said opposite ends thereof;

said pivot hole extending substantially perpendicular to said central plane;

each of said pair of hooks lying substantially along a circle, said circle having a center;

said each of said pair of hooks extending along a substantial portion of said circle to have a free end and a pivot end;

said pivot end of said hook having a pivot axis;

said circle having a portion being substantially adjacent to said pivot axis;

said pivot axis being substantially tangential to said portion of said circle;

said pivot axis being disposed within said pivot hole of said substantially rigid bar with said center of said circle of said hook being located substantially within said central plane of said substantially rigid bar during relative rotation of said pivot axis within said pivot hole;

said hook having a first bearing member substantially at one side of said pivot axis and a second bearing member substantially at the other side of said pivot axis;

said substantially rigid bar having a first side and a second side having portions which are substantially parallel with the central plane;

said first bearing member including an annular surface substantially perpendicular to said pivot axis for bearing against said first side of said substantially rigid bar at said pivot hole;

said second bearing member being disposed against at least a portion of said second side of said substantially rigid bar at said pivot hole;

said pivot axis including slot means at said second bearing member for biased inward deflection of said second bearing member during insertion of said pivot axis in said pivot hole during assmebly; and said central plane for extending vertically below the clothes hanger rod when both of said hooks are engaed with the clothes hanger rod and said central plane for extending vertically below the clothes hanger rod when only one of said hooks is engaged with the clothes hanger rod.

4. A multiple garment hanging device for simultaneously hanging and storing several articles of clothing or the like on a clothes hanger rod, said garment hanging device comprising:

a substantially rigid bar;

said substantially rigid bar having a plurality of holes extending therethrough for receipt of clothes hanging elements therein;

a pair of hooks pivotably mounted at opposite ends of said substantially rigid bar;

said substantially rigid bar having a central plane and a longitudinal axis lying substantially within said central plane;

said plurality of holes in said substantially rigid bar being separated one from the other and displaced substantially along said longitudinal axis;

each of said holes extending substantially perpendicular to said central plane;

said substantially rigid bar having a pivot hole at each of said opposite ends thereof;

said pivot holes extending substantially perpendicular to said central plane;

each of said pair of hooks lying substantially along a circle, said circle having a center;

said each of said pair of hooks extending along a substantial portion of said circle to have a free end and a pivot end;

said pivot end of said hook having a pivot axis;

said circle having a portion being substantially adjacent to said pivot axis;

said pivot axis being substantially tangential to said portion of said circle;

said pivot axis for being disposed within said pivot hole of said substantially rigid bar with said center of said circle of said hook being located substantially within said central plane of said substantially rigid bar during relative rotation of said pivot axis within said pivot holes;

said hook having a first bearing member substantially at one side of said pivot axis and a second bearing member substantially at the other side of said pivot axis;

said substantially rigid bar having a first side and a second side;

said first bearing member for bearing against said first side of said substantially rigid bar at said pivot hole;

said second bearing member for being disposed against at least a portion of said second side of said substantially rigid bar at said pivot hole;

said central plane for extending substantially vertical below the clothes hanger rod when both of said hooks are engaged with the clothes hanger rod and said central plane for extending substantially vertically below the clothes hanger rod when only one of said hooks is engaged with the clothes hanger rod.

5. A multiple garment hanging device for simultaneously hanging and storing several articles of clothing or the like on a clothes hanger rod, said garment hanging device comprising:

a substantially rigid bar;

said substantially rigid bar having a plurality of holes extending therethrough for receipt of clothes hanging elements therein;

a pair of hooks for being pivotably mounted at opposite ends of said substantially rigid bar;

said pair of hooks for being substantially alignable toward each other for being held by a human hand for supporting the garment hanging device at least during insertion of the clothes hanging elements in said holes of said rigid bar;

said substantially rigid bar defining a central plane and a longitudinal axis lying substantially within said central plane;

said plurality of holes in said substantially rigid bar being separated one from the other and displaced substantially along said longitudinal axis;

each of said holes extending substantially perpendicular to said central plane;

said substantially rigid bar having a pivot hole at each of said opposite ends thereof;

said pivot holes extending substantially perpendicular to said central plane;

each of said pair of hooks lying substantially along a circle, said circle having a center;

said each of said pair of hooks extending along a substantial portion of said circle to have a free end and a pivot end;

said pivot end of said hook having a pivot axis;

said circle having a portion being substantially adjacent to said pivot axis;

said pivot axis being substantially tangential to said portion of said circle;

said pivot axis for being disposed within said pivot hole of said substantially rigid bar with said center of said circle of said hook for being located substantially within said central plane of said substantially rigid bar during relative rotation of said pivot axis within said pivot hole;

said hook having a first bearing member substantially at one side of said pivot ais and a second bearing member substantially at the other side of said pivot axis;

said substantially rigid bar having a first side and a second side disposed on opposite sides of the central plane;

said first bearing member including an annular surface substantially perpendicular to said pivot axis for bearing against said first side of said substantially rigid bar at said pivot hole;

said second bearing member for being disposed against at least a portion of said second side of said substantially rigid bar at said pivot hole;

said pivot axis including slot means at said second bearing member for biased inward deflection of said second bearing member during insertion of said pivot axis in said pivot hole during assembly; and said central plane for extending substantially vertically below a clothes hanger rod when both of said hooks are engaged with the clothes hanger rod and said central plane for extending substantially vertically below the clothes hanger rod when only one of said hooks is engaged with the clothes hanger rod.

6. A multiple garment hanging device for simultaneously hanging and storing several articles of clothing or the like on a clothes hanger rod, said garment hanging device comprising:

a substantially rigid bar;

said substantially rigid bar having a plurality of holes extending therethrough for receipt of clothes hanging elements therein;

a pair of hooks for being pivotably mounted at opposite ends of said substantially rigid bar;

said substantially rigid bar defining a central plane and a longitudinal axis lying substantially within said central plane;

said plurality of holes in said substantially rigid bar being separated one from the other and displaced substantially along side longitudinal axis;

each of said holes extending substantially perpendicular to said central plane;

said substantially rigid bar having a pivot hole at each of said opposite ends thereof;

said pivot holes also extending substantially perpendicular to said central plane;

each of said pair of hooks lying substantially along a circle, said circle having a center;

said each of said pair of hooks extending along a substantial portion of said circle to have a free end and a pivot end;

said pivot end of said hook having a pivot axis;

said circle having a portion being substantially adjacent to said pivot axis;

said pivot axis being substantially tangential to said portion of said circle;

said pivot axis for being disposed within said pivot hole of said substantially rigid bar;

said hook having a first bearing member substantially at one side of said pivot axis and a second bearing member substantially at the other side of said pivot axis;

said first bearing member including an annular surface substantially perpendicular to said pivot axis for bearing against said first side of said substantially rigid bar at said pivot hole;

said second bearing member for being disposed against at least a portion of said second side of said substantially rigid bar at said pivot hole;

said pivot axis including slot means at said second bearing member for biased inward deflection of said second bearing member during insertion of said pivot axis in said pivot hole during assembly; and said pair of hooks for being substantially alignable toward each other upon insertion of said pivot axes into said pivot holes and for being held by a human hand for supporting the garment hanging device at least during insertion of the clothes hanging elements in said holes of said rigid bar;

said central plane for substantially extending vertically below the clothes hanger rod when both of said hooks are engaged with the clothes hanger rod and said central plane for substantially extending vertically below the clothes hanger rod when only one of said hooks is engaged with the clothes hanger rod.

7. A multiple garment hanging device for simultaneously hanging and storing several articles of clothing or the like on a clothes hanger rod, said garment hanging device comprising:

a substantially rigid bar;

said substantially rigid bar having a plurality of holes extending threrethrough for receipt of clothes hanging elements therein;

a pair of hooks for being pivotably mounted at substantially opposite ends of said substantially rigid bar;

said substantially rigid bar defining a substantially central plane and a longitudinal axis lying substantially within said central plane;

said plurality of holes in said substantially rigid bar being separated one from the other and displaced substantially along said longitudinal axis;

each of said holes extending substantially perpendicular to said central plane;

said substantially rigid bar having a pivot hole at each of said substantially opposite ends thereof;

said pivot holes extending substantially perpendicular to said central plane;

each of said pair of hooks lying substantially along a circle, said circle having a center;

said each of said pair of hooks extending along a substantial portion of said circle and having a free end and a pivot end;

said pivot end of said hook having a pivot axis;

said circle having a portion being substantially adjacent to said pivot axis;

said pivot axis being substantially tangential to said portion of said circle;

said pivot axis for being disposed within said pivot hole of said substantially rigid bar;

each said hook having means for holding its corresponding pivot axis in a pivot hole; and said central plane for extending substantially vertically below the clothes hanger rod when both of said hooks are engaged with the clother hanger rod and said central plane for extending substantially vertically below the clothes hanger rod when only one of said hooks is engaged with the clothes hanger rod.

* * * * *

UNITED STATES PATENT AND TRADEMARK OFFICE

CERTIFICATE OF CORRECTION

PATENT NO. : 4,953,717

DATED : September 4, 1990

INVENTOR(S) : Wilhelm Rösch

It is certified that error appears in the above-identified patent and that said Letters Patent is hereby corrected as shown below:

On the title page, after INID code [63], insert a new INID code [30]. It should read:

--Foreign Application Priority Data
Sept. 24, 1987 [DE] Fed. Rep. of Germany .... 8712870--.

the abstract section indicated by the INID code [57], on line 7, delete "end" and insert --ends--.

In column 2, line 2, after 'is', delete "advantageous" and insert --disadvantageous--.

In column 6, line 26, after 'clothes', insert --hanger--.

In column 9, line 23, after 'segment', insert --being--.

In column 9, line 24, after 'opening', insert --14--.

In column 12, line 4, after '66', delete "in" and insert --is--.

UNITED STATES PATENT AND TRADEMARK OFFICE

CERTIFICATE OF CORRECTION

PATENT NO. : 4,953,717

DATED : September 4, 1990

INVENTOR(S) : Wilhelm Rösch

It is certified that error appears in the above-identified patent and that said Letters Patent is hereby corrected as shown below:

In column 12, lines 43-44, after 'described', delete "hereinaboe" and insert --hereinabove--.

Column 18, line 1 delete "engaed" and insert --engaged--.

Column 18, line 42 after 'pivot', delete "holes;" and insert --hole;--.

Column 19, line 38 after 'pivot', delete "ais" and insert --axis--.

Signed and Sealed this

Twentieth Day of April, 1993

*Attest:*

*Attesting Officer*

MICHAEL K. KIRK

*Acting Commissioner of Patents and Trademarks*